United States Patent [19]

Akira et al.

[11] 4,300,986

[45] Nov. 17, 1981

[54] COKE OVEN DOOR CLEANER

[75] Inventors: Tsuzuki Akira, Yokohama; Tobitani Hiroshi, Kurisaki, both of Japan

[73] Assignee: Koritsu Machine Industry Limited, Japan

[21] Appl. No.: 141,130

[22] Filed: Apr. 17, 1980

[51] Int. Cl.[3] ..... C10B 43/04; C10B 43/08

[52] U.S. Cl. ..... 202/241; 15/93 A; 134/172

[58] Field of Search ..... 202/241; 201/2; 134/167 R, 168 R, 172, 173, 180, 181; 15/93 A

[56] References Cited

U.S. PATENT DOCUMENTS

| | | | |
|---|---|---|---|
| 3,822,191 | 7/1974 | Konno | 202/241 |
| 3,847,753 | 11/1974 | Baird et al. | 202/241 |
| 4,097,304 | 6/1978 | Taylor | 202/241 X |
| 4,097,340 | 6/1978 | Pries | 202/241 |
| 4,165,261 | 8/1979 | Henstra | 202/241 |

*Primary Examiner*—Frank W. Lutter
*Assistant Examiner*—Roger F. Phillips
*Attorney, Agent, or Firm*—McGlew and Tuttle

[57] ABSTRACT

A door cleaner is capable of automatically scraping a door side, knife edge and recessed inside surface to remove tar and the like adhered thereto. The cleaner can remove both viscous material at the knife edge and recessed inside surface of the door and dried and solid material at the door side close to the coking chamber. Jet nozzles are arranged on scraper devices for cleaning the knife edge and the recessed inside areas to completely scrape and further wash away the viscous tars adhered thereto.

3 Claims, 5 Drawing Figures

COKE OVEN DOOR CLEANER

BACKGROUND OF THE INVENTION

This invention relates to an improved coke oven door cleaner. The conventional horizontal chamber coke oven is equipped with a door at each of its opposite ends, namely the pusher side and the coke side. Each door, to which much tar and the like adhere when the coal is baked to form coke, must be cleaned before the next coking operation. However, such tar and the like that adhere to the door, are different in quality at different places on the door. That is, dried and solid substances adhere to the door side and bottom surfaces close to the coking chamber and viscous substances adhere to the knife edge and intermediate recessed inside surface which is relatively remote from the chamber. While the conventional door cleaners have simply been equipped with uniform scrapers and cutters, and accordingly result in a disadvantage that they require much time for a cleaning operation, they still have poor cleaning effect.

SUMMARY OF THE INVENTION

The present invention provides an improved coke oven door cleaner which is capable of thorough cleaning of every door surface where tar and the like have adhered in such condition as described above. Namely, for cleaning the door side surfaces where dried and solid tars have adhered doggedly, the improved coke oven door cleaner of this invention employs powerful radial cutters which scrape such tar while rotating and pressure-contacting the surface, and on the other hand, for cleaning the knife edge and intermediate recessed inside surfaces where viscous tars have adhered, it employs edge scrapers equipped with jet nozzles for jetting high pressure fluid to completely wash away the viscous tars adhered to the surfaces. Thus, the improved coke oven door cleaner of this invention enables a cleaning operation to be carried out in short periods of time and yet with efficiency.

DESCRIPTION OF PREFERRED EMBODIMENT

Figure 2:
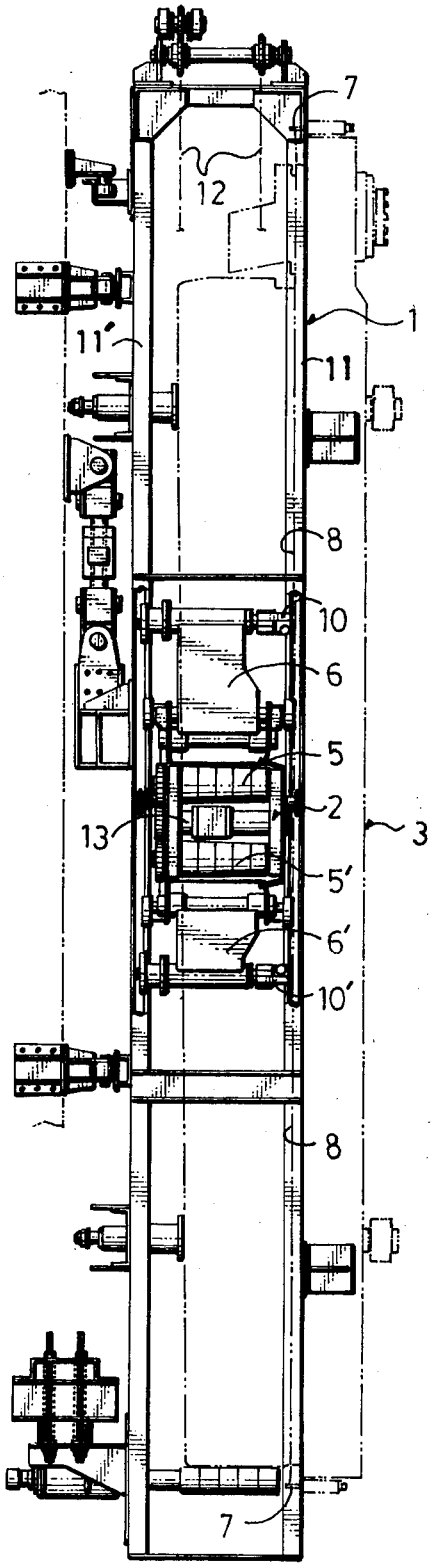
FIG. 2 is a side view of the door cleaner.
Figure 1:
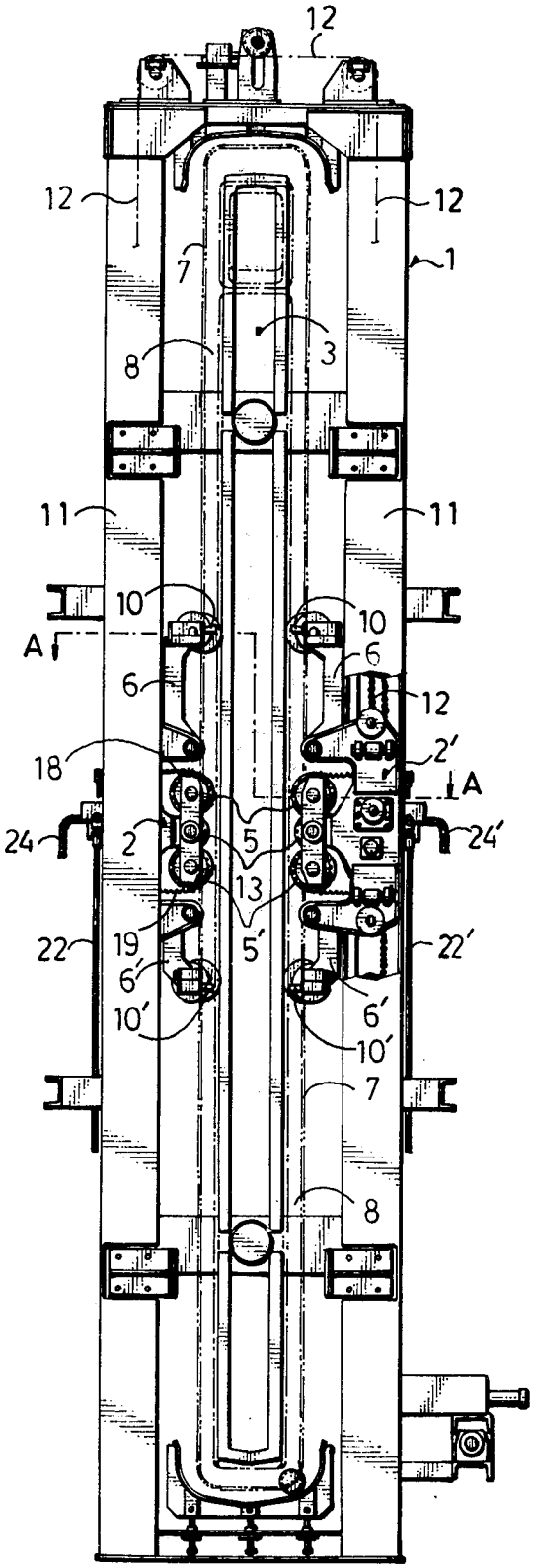
FIG. 1 is a front view of the coke oven door cleaner made in accordance with an embodiment of this invention.
Figure 3:
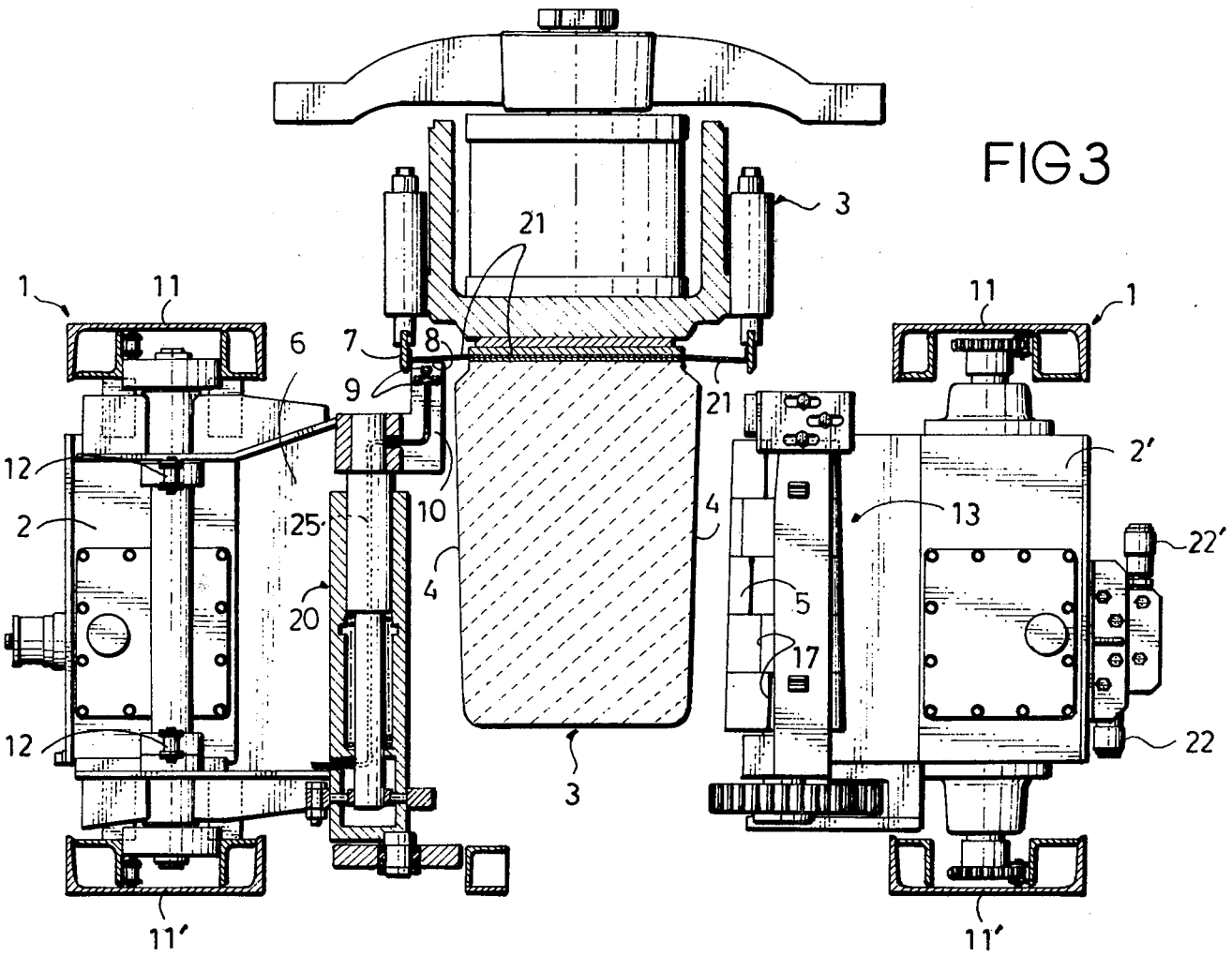
FIG. 3 is a cross-sectional view of the door, taken along the section line A—A of FIG. 1, the left half of which shows the edge scraper device and the right half the radial cutter device respectively.

Referring now to FIG. 1, a pair of hydraulically propelled carriers 2,2′ which are interconnected by chain 12, are respectively placed and are movable up and down on the guide channels 11, 11′ formed along the full length of the vertical frame 1, as disclosed in U.S. Pat. No. 3,822,191 to Konno.

Figure 4:
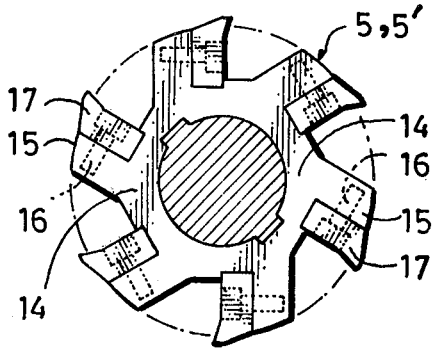
FIG. 4 is an enlarged view of the radial cutter.
Figure 5:
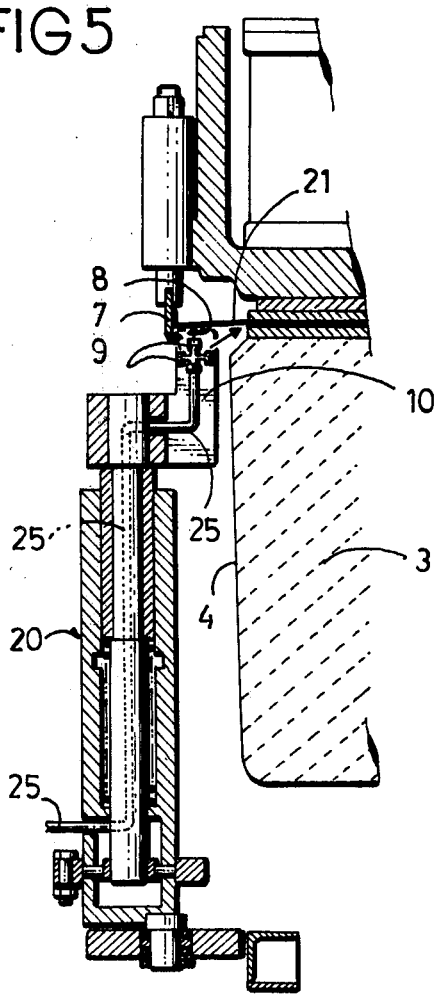
FIG. 5 is an enlarged front view of the edge scraper, showing the jet nozzle device.

On center projections of the carriers 2,2′ are respectively mounted oscillatable radial cutter devices which have upper and lower radial cutters 5, 5′ mounted on supporting members 13. As shown in FIG. 4, the radial cutters 5, 5′ comprise cross-sectionally windmill type members 14 and cutter blades 17 fastened on the fitting members thereof by bolts 16. The windmill type members 14 are arranged to be rotated through gear trans (not shown) contained in the carriers. On the upper and lower ends of the supporting members 13, there are fixed upper and lower tension springs 18, 19, the other ends of which are connected to the vertical frame 1. The upper and lower tension springs 18, 19 maintain the supporting members 13 vertically when the radial cutter devices are not driven.

Respective arms 6, 6′ are pivotally secured to the upper and lower ends of the carriers 2, 2′ as disclosed in said patent, and support respective scraper holders 20. The arms 6, 6′ and scraper holders 20 are driven in the same manner as described in said patent. On the head of the scraper holders 20 are mounted respective knife edge scrapers 10, 10′ for cleaning the intermediate recessed inside surface 8 of the knife edge 7. The knife edge scrapers 10, 10′ have mounted thereon, three jet nozzles 9 for jetting high pressure fluid. The three jet nozzles respectively face in three directions, namely to the knife edge 7, the sealing plate 21 and the door side 4. The jet nozzles 9 communicate with outside feed pipe 24, 24′ juxtaposed with the hydraulic pipe 22, 22′ of the carriers 2, 2′ through rubber pipes 25, 25′ passing through the scraper holders 20. Thus, high pressure fluid is fed to the jet nozzles 9 from a fluid supply source (not shown) through the outside feed pipes 24, 24′ and the rubber pipes 25, 25′. For the high pressure fluid, water or steam is preferred.

In operation, the door 3 to be cleaned is set properly in the vertical frame 1, with the supporting members 13 oriented vertically by the tension springs, and then the carriers 2, 2′ are moved alternatively up and down by the action of hydraulic devices (not shown) of the carriers fed with pressured oil through the hydraulic pipes 22, 22′. For instance, the lower radial cutter 5′ of the ascending carrier 2 is pressed toward the door side 4 by the action of the hydraulic device in the carrier and is rotated in such direction that it scrapes the door side 4 upward to completely clear the latter. While, the upper radial cutter 5 of the carrier is pulled outwardly of the door by the tension spring 19.

On the other hand, the upper radial cutter 5 of the descending carrier 2′ is pressed toward the door side 4 and is rotated in such direction that it scrapes the door side 4 downward to completely clear the latter.

By repeating such alternative up and down movement of the carriers 2, 2′, such dried and solid tars doggedly adhered in lamination layer on the door side can be completely scraped. While, the edge scraper 10 is moved into the recessed inside 8 of the knife edge 7 by a shifting rod (not shown) as disclosed in said patent and, as the carriers 2, 2′ move up and down, cleanly scrape and wash away the viscous tars adhered to the recessed inside of the door in cooperation with the high pressure fluid jetting from the jet nozzles 9 mounted thereon.

Thus, in accordance with the present invention, which has such cleaning devices arranged in a proper place as suitable to the respective surfaces to be cleaned of the coke oven door, there is such advantage that both the dried and solid tars and the viscous tars adhered thereon can now be efficiently cleaned from the door surfaces.

What is claimed is:

1. A cleaner for a coke oven door having a body with side walls, a sealing plate extending from the body having a recessed surface adjacent the side walls and a sealing blade connected to the sealing plate, the cleaner comprising:

a vertical support frame for receiving the coke oven door having a pair of elongated guide channels adapted to receive the coke oven door body therebetween, a pair of carriers mounted on said vertical support frame and engaged with each of said guide channels respectively for movement along the length of said guide channels;

hydraulic drive means connected to said vertical support frame and to said carriers for propelling said carriers along said guide channels;

radial cutting means connected to said carriers, on the side of said carriers adapted to face the side walls of the coke oven door body, said radial cutting means including at least one radial cutter rotatably mounted to each of said carriers on a substantially horizontal axis, said carriers and radial cutter means adapted to engage the side walls of the coke oven door body to scrape dried and hardened material therefrom;

a scraper pivotably mounted to each of said carriers adapted to bear against and scrape the recessed surface of the sealing plate; and a jet nozzle block connected adjacent an end of each of said scrapers adapted to be brought nearest to the recessed surface of the sealing plate, said jet nozzle blocks each having three orifices adapted to respectively face the sealing blade, the recessed surface of the sealing plate, and a portion of the side walls of the coke oven door body adjacent the recessed surface of the sealing plate; and high-pressured fluid source means connected to said jet nozzle block for supplying high pressure fluid to said jet nozzle blocks and through said orifices to cleanse the sealing blade, the sealing plates and the portion of the side wall of viscous material deposited thereon.

2. A cleaner according to claim 1, including a pair of said radial cutting means and a pair of said scrapers mounted to each of said carriers.

3. A cleaner according to claim 1, wherein the side walls of the body of the coke oven door are recessed inwardly toward each other adjacent the sealing plate, one of said orifices of each of said jet nozzle blocks directed toward the recesses of the side walls.

* * * * *